United States Patent [19]

Tsubata

[11] Patent Number: 5,042,117

[45] Date of Patent: Aug. 27, 1991

[54] ORNAMENTAL SLIDE FASTENER

[75] Inventor: Noritaka Tsubata, Uozu, Japan

[73] Assignee: Yoshida Kogyo K.K., Tokyo, Japan

[21] Appl. No.: 497,322

[22] Filed: Mar. 22, 1990

[30] Foreign Application Priority Data

Mar. 24, 1989 [JP] Japan ..... 1-72697
Oct. 31, 1989 [JP] Japan ..... 1-285508

[51] Int. Cl.[5] ..... A44B 19/00
[52] U.S. Cl. ..... 24/381; 24/432
[58] Field of Search ..... 24/381, 389, 393, 432

[56] References Cited

U.S. PATENT DOCUMENTS

| | | | |
|---|---|---|---|
| 2,251,137 | 7/1941 | Kay . | |
| 3,003,212 | 10/1961 | Emery | 24/381 X |
| 3,078,468 | 2/1963 | Piccione . | |
| 3,590,881 | 7/1971 | Van Amburg | 24/393 X |
| 3,974,550 | 8/1976 | Fujisaki et al. | 24/393 |
| 4,160,306 | 7/1979 | Pizzoccaro | 24/381 |

FOREIGN PATENT DOCUMENTS

| | | | |
|---|---|---|---|
| 299500 | 1/1989 | European Pat. Off. | 24/432 |
| 1757114 | 12/1957 | Fed. Rep. of Germany . | |
| 1804131 | 5/1969 | Fed. Rep. of Germany | 24/432 |
| 2729088 | 1/1978 | Fed. Rep. of Germany | 24/381 |
| 3726450 | 1/1983 | Fed. Rep. of Germany | 24/432 |
| 52-47908 | 4/1977 | Japan . | |
| 182027 | 1/1936 | Switzerland . | |
| 566743 | 9/1975 | Switzerland | 24/432 |
| 1408196 | 10/1975 | United Kingdom . | |

*Primary Examiner*—James R. Brittain
*Attorney, Agent, or Firm*—Hill, Van Santen, Steadman & Simpson

[57] ABSTRACT

An ornamental slide fastener comprises a pair of stringer tapes each having an upper strip and a lower strip interconnected by a rib about which the tape is folded, a row of coupling elements secured to the lower strip, the two strips defining therebetween a guide channel for receiving a slider and a series of ornaments applied to the upper strip end extending into the region of the rib so that continuity of the ornaments is maintained against the influence of lateral pull tending to spread the two tapes apart.

6 Claims, 4 Drawing Sheets

ORNAMENTAL SLIDE FASTENER

BACKGROUND OF THE INVENTION

1. Field of the Invention

This invention relates to slide fasteners and more particularly to such a slide fastener which has an ornamental appearance compatible with a garment article to which the fastener is applied.

2. Prior Art

The role of conventional slide fasteners has been primarily to ensure efficient and smooth closing and opening of a garment fabric to which they are attached, thus with emphasis on the functional aspect of the slide fastener. Great emphasis is now on its ornamental aspect to render the fastener compatible or harmonious with a companion garment article such as apparel, sportswear, bags and the like which have recently become more and more fashionable and sophisticated. Thus, fashionableness of slide fasteners themselves is now an important design consideration in their manufacture. There have been proposed various devices for providing such fashionable slide fasteners typically by applying an ornament in the form of indicia, markings, pictorial images and the like onto the fastener tapes. In such instance, it would be desirable to locate the ornaments integrally over and across the confronting longitudinal edges of a pair of stringer tapes in order to present a slide fastener in the most impressive, harmonious manner. However, the stringer tapes carry rows of coupling elements along their respective longitudinal edges, which rows of elements tend to disrupt the continuity and integrity of the ornaments applied onto the tapes, resulting in indistinct, unsightly appearance of the slide fastener.

In attempts to eliminate the aforesaid difficulties, it has been proposed to provide a slide fastener having a continuous helical or meander formation of coupling elements attached to one surface of each of two opposed stringer tapes along the respective longitudinal edges which can be brought closely together when the fastener is closed. The opposite surface of each tape is used as a front exposed to view for application of desired ornaments by means of printing or dyeing, which ornaments are arranged to extend over and across the confronting edges of the tapes. This proposal has however met with the difficulty that the ornaments are prone to get scratched on repeated frictional contact with a slider moving to open or close the fastener. This is aggravated where sewing threads securing the coupling elements to the tapes are exposed on the ornaments, resulting in very unsightly fastener product.

It has also been proposed, as disclosed for example in U.S. Pat. No. 2,251,137, to use a pair of ornamental strips having identical ornament halves and sewn to respective stringer tapes of a slide fastener so as to couple the ornament halves together to present a continuous ornamental in closed disposition of the slide fastener. This prior art device has a drawback in that the ornamental strips superposed on the respective stringer tapes make the slide fastener necessarily bulky, hence disharmonious with some garment articles and therefore restrict the extent to which such fastener can be used in commerce. Another drawback is in that the ornamental strips are disposed to flap freely up and down as they are stitched at their blank or ornament-free areas to the stringer tapes and are therefore liable to make the arrangement of the ornaments somewhat discontinuous even when the strips meet closely together. This would be noticeable particularly when lateral pull is exerted tending to spread the opposed strips apart.

SUMMARY OF THE INVENTION

With the foregoing difficulties and drawbacks of the prior art in view, the present invention seeks to provide an ornamental slide fastener having an arrangement of ornaments which is provided in such a manner that the ornaments may be displayed most impressively as a continuous image and protected against the effect of a slider operation which would otherwise impair the ornaments.

One aspect of the invention is to provide an ornamental arrangement extending over and across the longitudinal edges of a pair of opposed stringer tapes.

Another aspect of the invention is to provide an ornamental arrangement only on one of the two stringer tapes.

According to one embodiment of the invention, there is provided an ornamental slide fastener which comprises a pair of opposed stringer tapes each having a web portion and an upper strip extending integrally from the web portion along an inner longitudinal edge of the tape, an abutting rib about which the upper strip is folded, the rib on one tape lower strip extending from the rib and underlying the upper strip, a row of coupling elements secured to the lower strip, the upper strip and the lower strip defining therebetween a guide channel extending longitudinally throughout the length of each of the tapes and adapted to receive a slider, and a series of ornaments subdivided to provide one half on the upper strip on one tape and the other half on the upper strip on the other tape.

According to another embodiment of the invention, there is provided an ornamental slide fastener which comprises a pair of opposed stringer tapes each having a web portion and an upper strip extending integrally from the web portion along an inner longitudinal edge of the tape, an abutting rib about which the upper strip is folded, the rib on one tape intimately engageable with that on the opposite tape, a lower strip extending from the rib and underlying the upper strip, a row of coupling elements secured to the lower strip, the upper strip and the lower strip defining therebetween a guide channel extending longitudinally throughout the length of each of the tapes and adapted to receive a slider, the upper strip on one stringer tape being wider than that on the other stringer tape and adapted to provide thereon a series of ornaments.

The invention will be described in detail with reference to the accompanying drawings which illustrate by way of example some preferred embodiments.

DETAILED DESCRIPTION OF THE INVENTION

Figure 1:
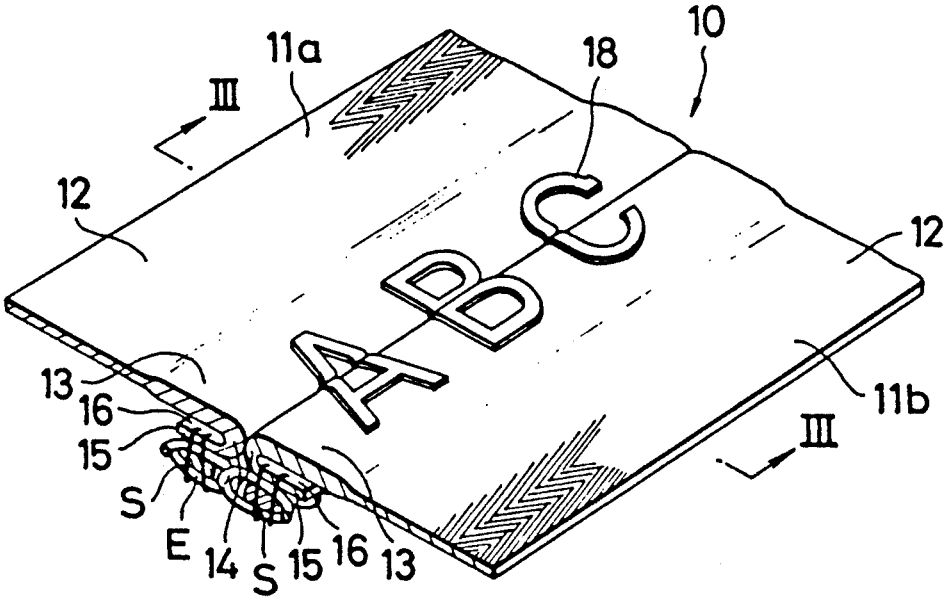
FIG. 1 is a fragmentary perspective view of an ornamental slide fastener embodying the invention.

Referring now to the drawings and FIG. 1 in particular, there is shown an ornamental slide fastener 10 which comprises a pair of opposed stringer tapes 11*a* and 11*b* each of which consists of a web portion 12 and a thickened upper strip 13 extending integrally from the web portion 12 along an inner longitudinal edge of the tape 11*a* (11*b*). The upper strip 13 may be formed by Dobby or Jacquard loom, or by lacing, whichever is more convenient, while the web portion 12 is formed by an ordinary weaving or knitting loom. The upper strip 13 is folded on itself to provide an abutting rib 14 and a lower strip 15 extending therefrom to underly the upper strip 13. The lower strip 15 and the upper strip 13 define therebetween a guide channel 16 having a substantially "U"-shape cross-section and extending longitudinally throughout the length of the tape 11*a* (11*b*) for receiving a slider 17 as shown in FIG. 3.

A row of continuous coupling elements E in the form of a helical coil or meandering structure is secured by stitchings S to the lower surface of one lower strip 15 and is taken into and out of coupling engagement with a companion row of elements E on the opposite lower strip 15 by the action of the slider in a manner well known in the art.

Figure 2:
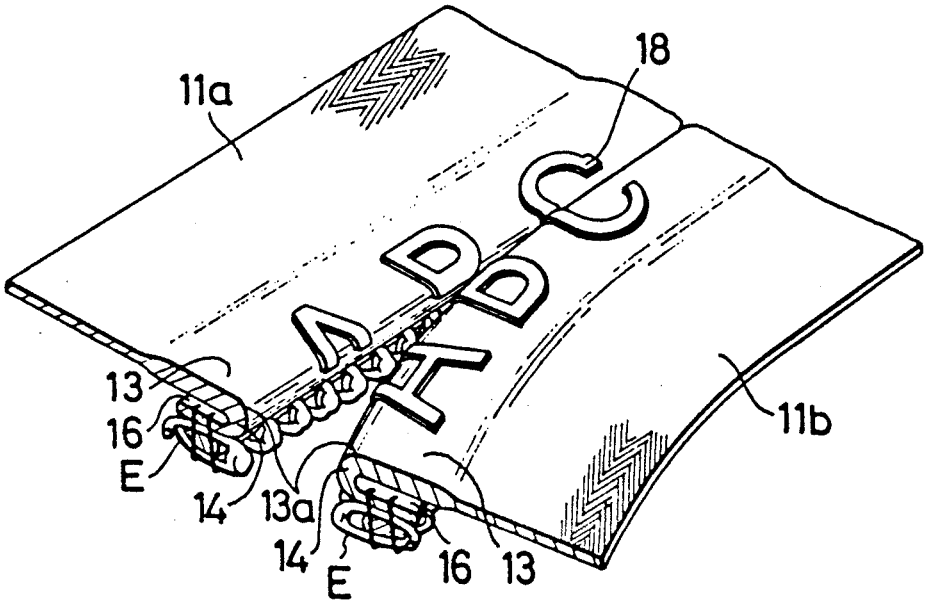
FIG. 2 is a view similar to FIG. 1 but showing the fastener partly open.
Figure 3:
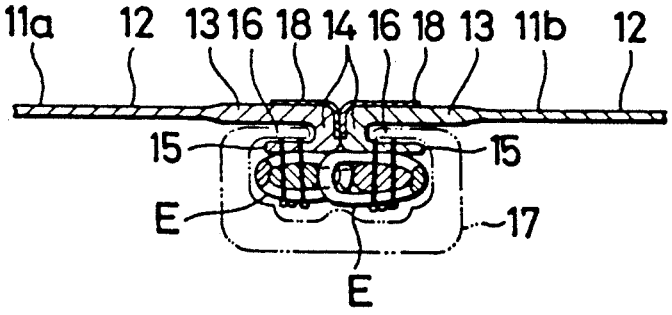
FIG. 3 is a transverse cross-sectional view taken on the line III—III of FIG. 1 with a slider indicated by phantom line.

In the embodiment shown in FIGS. 1–3, there is provided a series of ornaments 18 in the form of alphabets as presently shown or other suitable indicia, pictorial images and the like which contribute to enhanced ornamental representation compatible or harmonious with any garment article. One half of each ornament 18 extends beyond a marginal edge 13*a* of the upper strip 13 into the abutting rib 14 and terminates short of the lower surface of the lower strip 15, so that when the ribs 14 on the respective tapes 11*a*, 11*b* are brought into intimate abutting engagement by manipulation of the slider 17, the one half of ornament 18 on one tape 11*a* is likewise brought into abutting engagement with the other half of ornament 18 on the opposite tape 11*b* to present a substantially continuous, integral ornamental image, as better shown in FIG. 1.

Figure 4:
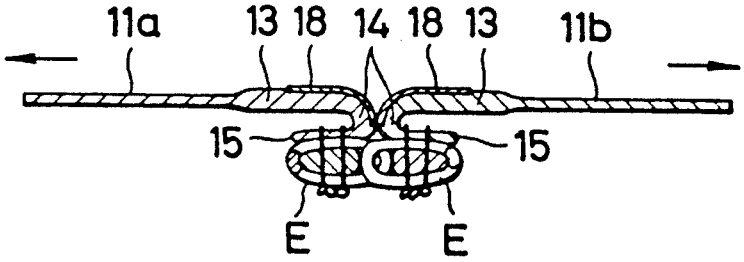
FIG. 4 is a view similar to FIG. 3 but showing slide fastener subjected to lateral pull exerted in the direction of the arrow.

Extension of the ornaments 18 into the region of the rib 14 about which the upper strip 13 is folded, ensures continuity or integrity of the ornaments 18 even in the event a lateral pull is extended to spread the two tapes 11*a* and 11*b* apart as shown in FIG. 4.

Figure 5:
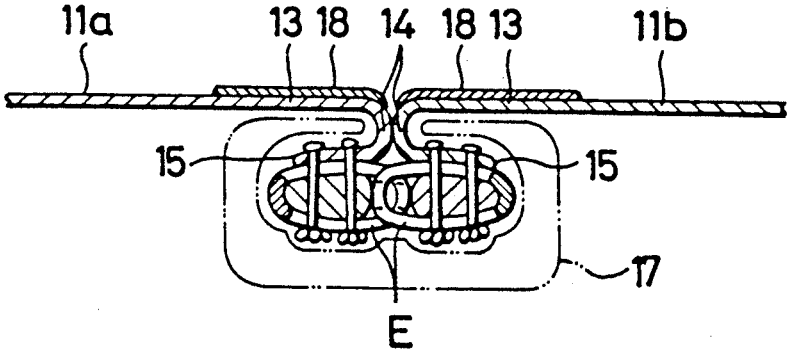
FIG. 5 is a transverse cross-sectional view of a modified form of ornamental slide fastener according to the invention.

There may be considered various ways of providing the ornaments 18 on the tapes 11*a* and 11*b*. The ornaments 18 may be printed or dyed on the tapes 11*a*, 11*b* prior to attachments thereto of coupling elements E, or after this attachment while the tapes 11*a*, 11*b* are subjected to transverse or lateral tension. Alternatively, the ornaments 18 may be formed on a plastics film or a flocked fabric and applied to the tapes 11, 11 by means of high frequency, supersonic, heat and pressure or adhesive treatment. The ornaments 18 may also be formed by direct electrostatic flocking of the tapes 11*a*, 11*b*.

Where the case permits, the ornaments 18 may extend in close proximity to the ribs 14 of the tapes 11*a*, 11*b* or to an extent possible to maintain continuity of the ornaments 18 as shown in FIG. 5.

Figure 6:
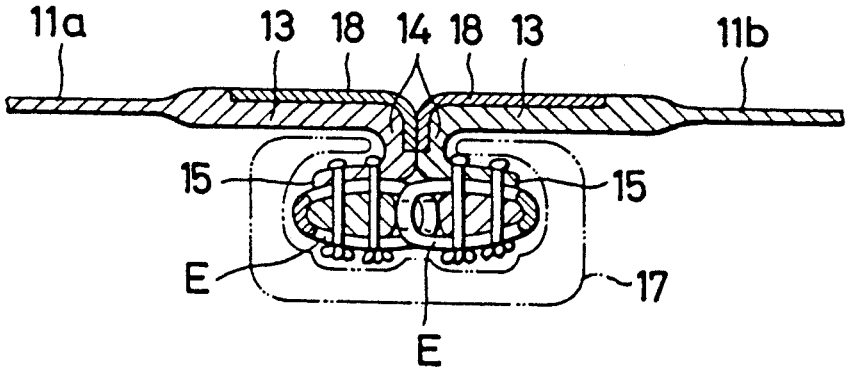
FIG. 6 is a transverse cross-sectional view of another modified form of ornamental slide fastener according to the invention.

FIG. 6 shows a variation of the ornamental slide fastener 10 (FIGS. 1–3) in which the ornaments 18 are embedded in the upper strip 13 to lie flush with the upper surface of the latter.

Figure 7:
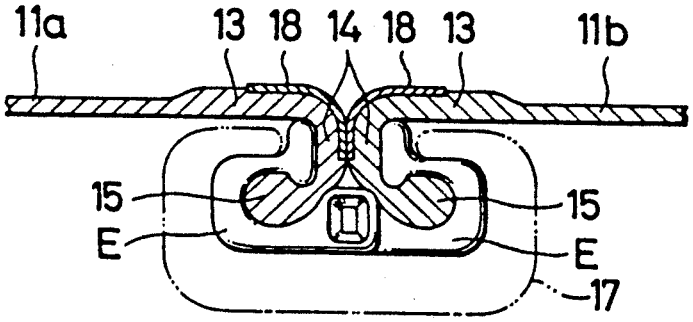
FIG. 7 is a transverse cross-sectional view of a further modified form of ornamental slide fastener according to the invention.

FIG. 7 shows another variation which is substantially similar to the fastener 10 except that the coupling elements E attached to the respective tapes 11*a*, 11*b* are in the form of a discrete structure.

Figure 8:
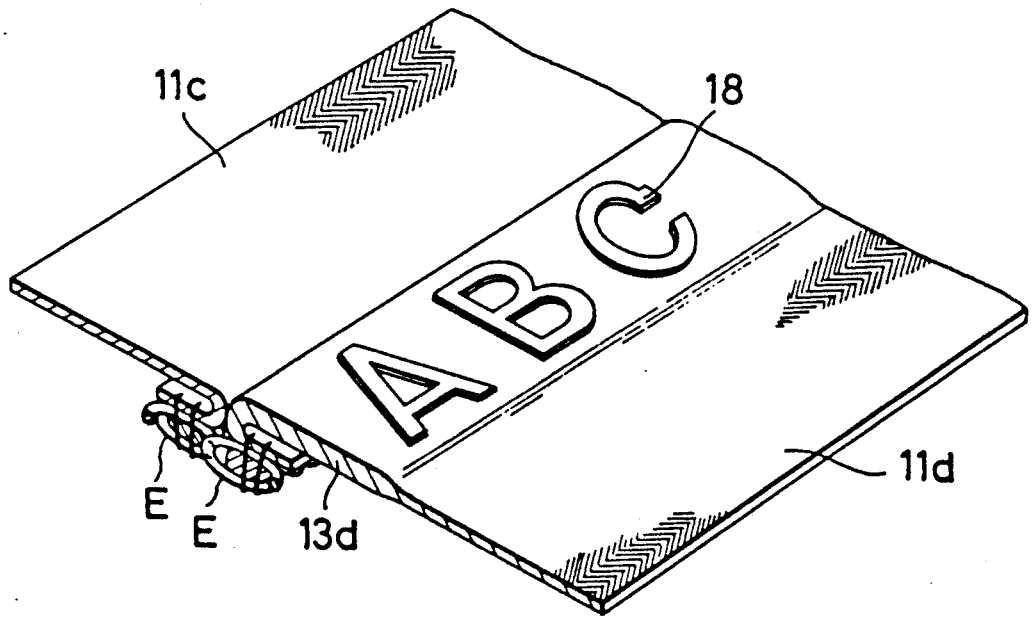
FIG. 8 is a fragmentary perspective view of still another modified form of ornamental slide fastener according to the invention.

FIG. 8 shows a modified form of ornamental slide fastener 10 embodying the invention which comprises a narrow width stringer tape 11*c* of a thickness uniform throughout its whole area including the folded edge and a wide width stringer tape 11*d* which has a thickened upper strip 13*d* similar to but somewhat wider than the upper strip 13 in FIG. 1. The ornaments 18 are applied onto the region of the upper strip 13*d* by means already described hereinabove.

Advantageously, in all of the illustrated embodiments of the invention, the ornaments 18 are displayed distinctly and impressively as a continuous image and are protected against abrasive wear by the arrangement in which the slider 17 is guidedly received in the guide channel 16 formed between the upper strips 13, (13*b*) and the lower strips 15.

Obviously, various modifications and variations of the present invention are possible in the light of the above teaching. It is therefore to be understood that within the scope of the appended claims the invention may be practiced otherwise than as specifically described.

What is claimed is:

1. An ornamental slide fastener which comprises a pair of opposed stringer tapes each having a web portion and an upper strip extending integrally from said web portion along an inner longitudinal edge of said tape, an abutting rib about which said upper strip is folded, said rib on one tape intimately engageable with that on the opposite tape, a lower strip extending from said rib and underlying said upper strip, a row of coupling elements secured to said lower strip, said upper strip and said lower strip defining therebetween a guide channel extending longitudinally throughout the length of each of said tapes and adapted to receive a slider, and a series of ornaments subdivided to provide one half on said upper strip on the one tape and the other half on said upper strip on the other tape and extending beyond a marginal edge of said upper strip into the region of said abutting rib.

2. An ornamental slide fastener according to claim 1 wherein said ornaments extend into the region of said rib and terminate short of the lower surface of said lower strip.

3. An ornamental slide fastener according to claim 1 wherein said upper strip is thicker than said web portion.

4. An ornamental slide fastener according to claim 1 wherein said ornaments are embedded in said upper strip to lie flush with the upper surface thereof.

5. An ornamental slide fastener which comprises a pair of opposed stringer tapes each having a web portion and an upper strip extending integrally from said web portion along an inner longitudinal edge of said tape, an abutting rib about which said upper strip is folded, said rib on one tape intimately engageable with that on the opposite tape, a lower strip extending from said rib and underlying said upper strip, a row of coupling elements secured to said lower strip, said upper strip and said lower strip defining therebetween a guide channel extending longitudinally throughout the length of each of said tapes and adapted to receive a slider, said upper strip on one stringer tape being wider and thicker than that on the other stringer tape and adapted to provide thereon a series of ornaments.

6. An ornamental slide fastener according to claim 5, wherein said ornaments are embedded in said upper strip to lie flush with the upper surface thereof.

* * * * *